US006336405B1

(12) United States Patent
Kawata et al.

(10) Patent No.: US 6,336,405 B1
(45) Date of Patent: Jan. 8, 2002

(54) PUMP FOR PRINTING MACHINE

(75) Inventors: Tomoshi Kawata, Yokohami; Yosuke Nobuta, Yokohama, both of (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/641,241

(22) Filed: Aug. 18, 2000

(30) Foreign Application Priority Data

Aug. 27, 1999 (JP) ..... 11-242147

(51) Int. Cl.[7] ..... B41F 31/08; F04B 19/22

(52) U.S. Cl. ..... 101/480; 101/366; 417/326; 417/415

(58) Field of Search ..... 101/365, 366, 101/DIG. 45, 480; 417/415, 326, 319

(56) References Cited

U.S. PATENT DOCUMENTS 3,366,051 A * 1/1968 Fusco ..... 101/366
4,461,209 A * 7/1984 Washcynonsky et al. ... 101/366
5,168,807 A * 12/1992 Elia et al. ..... 101/366
5,460,091 A * 10/1995 Mazzenga et al. ..... 101/366
5,472,324 A * 12/1995 Atwater ..... 101/366
5,526,745 A * 6/1996 Uera ..... 101/366

FOREIGN PATENT DOCUMENTS

JP 2864447 12/1998

* cited by examiner

*Primary Examiner*—Daniel J. Colilla
(74) *Attorney, Agent, or Firm*—Foley & Lardner

(57) ABSTRACT

In a pump intermittently rotated and controlled by a motor, the motor, etc. rise in temperature and ink supply is unstable when an operation of the pump is stopped in a magnetizing state. Therefore, the invention resides in a pump for a printing machine characterized in that the pump has a base; a cylinder having a suction hole and a discharge hole opened in positions different from each other in phase on the inner circumferential face of a main hole; a plunger fitted to an opening side of the main hole of the cylinder so as to be axially moved and rotated from an end tip of the main hole and closing the suction hole or/and the discharge hole; a motor attached to the base such that a rotating central line of a rotating shaft crosses that of the plunger at a predetermined crossing angle; a transmission mechanism constructed by an arm and a connection member; and retrogression preventing means for arranging the plunger temporarily stopped at a discharging stroke during an operation of the pump intermittently operated by the motor such that the plunger is not retreated and not angularly displaced in a direction reverse to a predetermined operating direction.

4 Claims, 10 Drawing Sheets

TERMINATION OF SUCKING STROKE
(UPPER DEAD POINT)

DISCHARGING STROKE

DISCHARGING STROKE

TERMINATION OF DISCHARGING STROKE
(LOWER DEAD POINT)

SUCKING STROKE

SUCKING STROKE

PUMP FOR PRINTING MACHINE

BACKGROUND OF THE INVENTION

1. Field of the Invention

This invention relates to a pump for a printing machine for supplying ink while a plunger is rotated and reciprocated by a motor in an offset printing machine.

2. Description of the Background Art

There are conventionally many known examples of a pump for an offset printing machine. For example, Japanese Patent No. 286447 (prior art) discloses an ink pump for a printing machine for supplying ink by repeatedly reciprocating a plunger within a cylinder once while the plunger is rotated once by using a variable speed motor.

In the pump for a printing machine of the prior art, as shown in FIG. 7, a cylinder 102 has a suction hole 121 and a discharge hole 122 opened in positions in which a main hole 120 closed on one side thereof is shifted by 180 degrees in phase. This cylinder 102 is fixed to one side of a base 101 through the space of a hollow portion thereof. A plunger 103 is fitted and inserted into the main hole 120 of the cylinder 102 on the other side thereof so as to be rotated and reciprocated. The cylinder 102 is closed by the plunger 103. One portion of a fitting circumferential face of the plunger 103 to the cylinder 102 is notched until its end tip and one end of the plunger 103 is projected from the other side of the main hole 120 to the hollow portion of the base 101 such that either the suction hole 121 or the discharge hole 122 can be communicated with the main hole 120 by rotating the plunger 103.

A variable speed motor 104 is attached to the base 101 in accordance with the plunger 103. An output shaft 140 of the variable speed motor 104 is projected to the hollow portion of the base 101. A rotating central line of the output shaft 140 is set to cross a rotating central line of the plunger 103 by a predetermined angle. Further, an arm 160 is attached to the output shaft 140 so as to project to the hollow portion. A spherical bearing 162 arranged at the other end of the arm 160 and an end portion side of the plunger 103 are connected to each other by a connection member 161 so that a crossing angle between the rotating central line of the output shaft 140 and an axis of the connection member 161 can be changed.

The crossing angle between the rotating central line of the output shaft 140 and the axis of the connection member 161 becomes maximum at the final stage of a sucking stroke and becomes minimum at the final stage of a discharging stroke at the time of a rotating phase in which the plunger 103 simultaneously closes the suction hole 121 and the discharge hole 122 every half rotating phase of the plunger 103.

FIGS. 8*a* to 8*f* are partial sectional perspective explanatory views showing an operating mode of the plunger 103 of the prior art, showing an operating mode where the plunger 103 is reciprocated once while the plunger 103 is fitted into the main hole 120 of the cylinder 102 and is rotated once in the direction of an arrow X.

FIG. 8*a* shows a terminating state of the sucking stroke in which the plunger 103 is located at an upper dead point and closes the suction hole 121 and the discharge hole 122.

FIGS. 8*b* and 8*c* show states of the discharging stroke. In these states, while the suction hole 121 is closed, the plunger 103 is moved in an inserting direction of the main hole 120 while the plunger 103 is rotated in the direction of the arrow X. Then, ink is discharged from the discharge hole 122.

FIG. 8*d* shows a terminating state of the discharging stroke in which the plunger 103 is located at a lower dead point and closes the suction hole 121 and the discharge hole 122.

FIGS. 8*e* and 8*f* show states of the sucking stroke. In these states, while the discharge hole 122 is closed, the plunger 103 is moved in a direction pulled out of the main hole 120 while the plunger 103 is rotated in the direction of the arrow X. The ink is then sucked from the suction hole 121.

In the pump P of the prior art, ink piping is connected between a fluid passage on an ink discharging side and an ink rail to discharge the ink sucked from an external ink tank.

When the variable speed motor 104 for operating the plunger 103 is a stepping motor 104 shown in an embodiment mode of the prior art, rotation of this stepping motor is controlled by a pulse signal. When it is not necessary to discharge the ink, or when the stepping motor is intermittently driven to adjust a discharging amount of the ink, the rotation of a rotor of the stepping motor 104 corresponding to the plunger 103 is stopped in accordance with necessity. Further, an exciting current flows through the stepping motor to self-hold a stopping position of this stepping motor 104, or the electric current flowing through the stepping motor 104 corresponding to the plunger 103 is interrupted in accordance with necessity so that an unmagnetizing state is set. Thus, the operation of the plunger 103 is ceased or is temporarily stopped.

The above prior art has several problems to be solved. For example, in the pump P of the prior art, the internal pressure of the ink pipe on the discharging side is increased by a discharging pressure of the ink at the discharging stroke of the ink so that force for pushing back the plunger 103 is caused. Further, at the discharging stroke of the ink, the crossing angle between the rotating central line of the output shaft 140 and the axis of the connection member 161 is gradually changed from a maximum angle to a minimum angle. Accordingly, the force for pushing back the plunger 103 is applied such that the arm 160 is angularly displaced in a reverse direction through the connection member 161 and the spherical bearing 162. Thus, the output shaft 140 begins to be angularly displaced in the reverse direction.

In rotating control using the stepping motor 104, a method for performing a magnetizing operation by flowing an electric current through winding of the stepping motor 104 is adopted to give self holding force to the output shaft 140 such that the output shaft 140 is not rotated by an external force during stoppage of the stepping motor. The stepping motor 104 is heated by this magnetizing electric current. There is a case in which the surface temperature of the stepping motor 104 is increased to 60 degrees centigrade or more in accordance with an operating condition of the pump P.

When the printing machine is operated at a relatively low speed, or the number of image lines of a printing plate is small, an ink supplying amount per unit time is small so that a stopping time of the pump P is lengthened. Therefore, the exciting current flows through the stepping motor during the stoppage of the pump P so that the stepping motor is heated. Accordingly, there is a case in which the stepping motor abnormally rises in temperature.

The temperature due to these heatings is transmitted to the base 101 and the cylinder 102 is heated so that the temperature of the ink rises and ink viscosity is reduced and the ink supplying amount becomes unstable and has a bad influence on printing quality. Further, when the electric current flowing through the stepping motor 104 is interrupted at the time of a pump stopping state during the operation of the printing machine to avoid this heating and no magnetizing operation is performed to restrain the heating, the plunger 103 is pushed back by the internal pressure of the ink piping on the discharging side caused by the ink discharging stroke. Displacement of the plunger 103 is transmitted to the arm 160 through the connection member 161 and the spherical bearing 162 so that the output shaft 140 is angularly displaced in a reverse direction. As a result, pulse signals are again transmitted by the next control amount from an unillustrated control means with a returning position of the plunger 103 as a starting point so that the stepping motor 104 is angularly displaced. Accordingly, the discharging amount of the ink is reduced by the returning amount of the plunger 103.

FIG. 9 is a graph of an arm rotating curve showing the relation of an arm rotating angle with respect to an arm rotating period in the prior art and the internal pressure of a fluid passage on a side of the discharge hole, and an internal pressure curve of the ink piping on the discharging side. When there is a resistance object such as an ink rail, etc. at a terminal of the ink piping on the discharging side of the pump of the prior art, the relation of the discharging side pressure of the pump P and the arm rotating period is explained by this graph.

An arm rotating curve (A) shown by a broken line shows a case in which there is no loss of the angular displacement of the arm in a reverse direction at the discharging stroke and rotating stoppage of the arm is ideally repeated. An arm rotating curve (B) shown by a solid line shows a case in which the ink is discharged while the angular displacement of the arm is repeated in the reverse direction by the internal pressure every time the arm is operated at the discharging stroke. The arm rotating curves (A) and (B) also show a relation for controlling the operation of the pump such that a group of pulse signals required to angularly displace the arm by 45 degrees are given to the stepping motor so as to displace the arm and the stepping motor is then stopped by the number of pulses corresponding to this displacement. When a group of pulse signals for continuously angularly displacing the arm by 45 degrees are given to the stepping motor four times, the stepping motor is angularly displaced by 180 degrees and the arm is angularly displaced by 180 degrees so that the sucking stroke is terminated. Thereafter, when a group of pulse signals are similarly given four times, the arm is angularly displaced by the next 180 degrees without any loss with respect to the arm rotating curve (A) and the discharging stroke is terminated.

As can be seen from FIG. 9, when the stepping motor is rotated 360 degrees, one rotating period of the arm is terminated. A rightward rising gradient portion at the sucking stroke of each of the arm rotating curves (A) and (B) shows that the arm is being normally angularly displaced in a predetermined operating direction. Further, a portion of each of the arm rotating curves (A) and (B) parallel to an axis of abscissa shows that the pump P is being stopped. Namely, when the pump P, is stopped, the arm rotating curve (B) must be originally parallel to the axis of absissa, but this curve portion shows a rightward falling gradient at the discharging stroke of the prior art. This shows that the arm is returned and is angularly displaced in the reverse direction. Namely, the output shaft of the stepping motor is angularly displaced in the reverse direction and a substantial angular displacing amount of the arm is reduced. Accordingly, the rotating period of the arm rotated once is lengthened so that the relation of the arm and the control system transmitting rotating commands to the pump is unbalanced and a suitable amount of ink is not supplied and the ink is insufficient. Thus, problems exist in that the ink amount required on a printing paper face is not supplied to the printing face, and ink density on the printing paper face is reduced, causing printing quality to be reduced.

SUMMARY OF THE INVENTION

To simultaneously solve the above problems in the prior art, an object of this invention is to provide a pump for a printing machine in which a plunger temporarily stopped at a discharging stroke during an operation of the pump intermittently separately operated by a motor is not retreated and angularly displaced in a direction reverse to a predetermined operating direction so that a required ink amount can be supplied onto a printing paper face.

To solve the above problems, this invention provides a pump for a printing machine for sucking and discharging ink by repeatedly reciprocating a plunger operated by a motor once while the plunger is rotated once within a main hole of a cylinder, the pump comprising:

a base;

the cylinder which is attached to the base and has the main hole closed on one side thereof and also has a suction hole and a discharge hole opened in positions different from each other in phase on an inner circumferential face of the main hole;

the plunger which is fitted onto an opening side of the main hole of the cylinder so as to be axially moved and rotated from an end tip of the main hole and simultaneously close the suction hole and the discharge hole of the cylinder in a certain rotating phase and also close one of the suction hole and the discharge hole in a different rotating phase;

the motor attached to the base such that a rotating central line of a rotating shaft crosses that of the plunger at a predetermined crossing angle;

a transmission mechanism which is constructed by an arm fixed to the output shaft of the motor and approximately projected in parallel with the rotating central line of the output shaft of the motor, and is also constructed by a connection member slidably attached to an inner ring hole of a spherical bearing fixed to the arm and fixed to a rear end side of the plunger and connecting the arm and the plunger to each other; and retrogression preventing means for arranging the plunger temporarily stopped at a discharging stroke during an operation of the pump intermittently operated by the motor such that the plunger is not retreated and not angularly displaced in a direction reverse to a predetermined operating direction.

This invention also provides a pump for a printing machine for sucking and discharging ink by repeatedly reciprocating a plunger operated by a motor once while the plunger is rotated once within a main hole, the pump comprising:

a cylinder-base which has the main hole closed on one side thereof and also has a suction hole and a discharge hole opened in positions different from each other in phase on an inner circumferential face of the main hole;

the plunger which is fitted onto an opening side of the main hole so as to be axially moved and rotated from an end tip of the main hole and simultaneously close the suction hole and the discharge hole in a certain rotating phase and also close one of the suction hole and the discharge hole in a different rotating phase;

the motor attached to the cylinder-base such that a rotating central line of a rotating shaft crosses that of the plunger at a predetermined crossing angle;

a transmission mechanism which is constructed by an arm fixed to the output shaft of the motor and approximately projected in parallel with the rotating central line of the output shaft of the motor, and is also constructed by a connection member slidably attached to an inner ring hole of a spherical bearing fixed to the arm and fixed to a rear end side of the plunger and connecting the arm and the plunger to each other; and retrogression preventing means for arranging the plunger temporarily stopped at a discharging stroke during an operation of the pump intermittently operated by the motor such that the plunger is not retreated and not angularly displaced in a direction reverse to a predetermined operating direction.

The above retrogression preventing means is arranged in at least one rotating member of the plunger having a rotating action, the arm and the output shaft of the motor.

DESCRIPTION OF THE PREFERRED EMBODIMENTS

Figure 1:
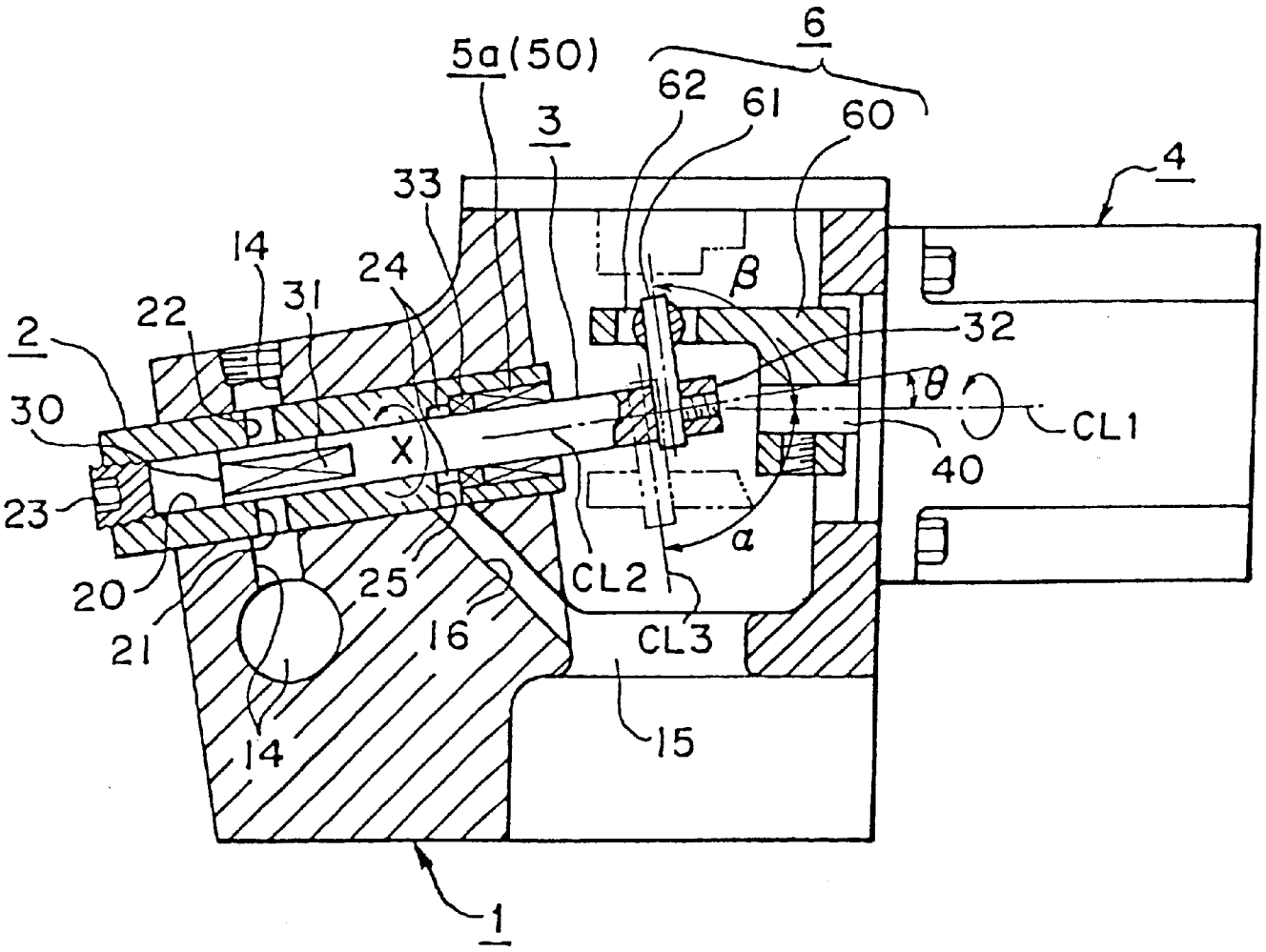
FIG. 1 is a cross-sectional view taken along an AA line of FIG. 5 and showing a first embodiment mode of this invention.
Figure 2:
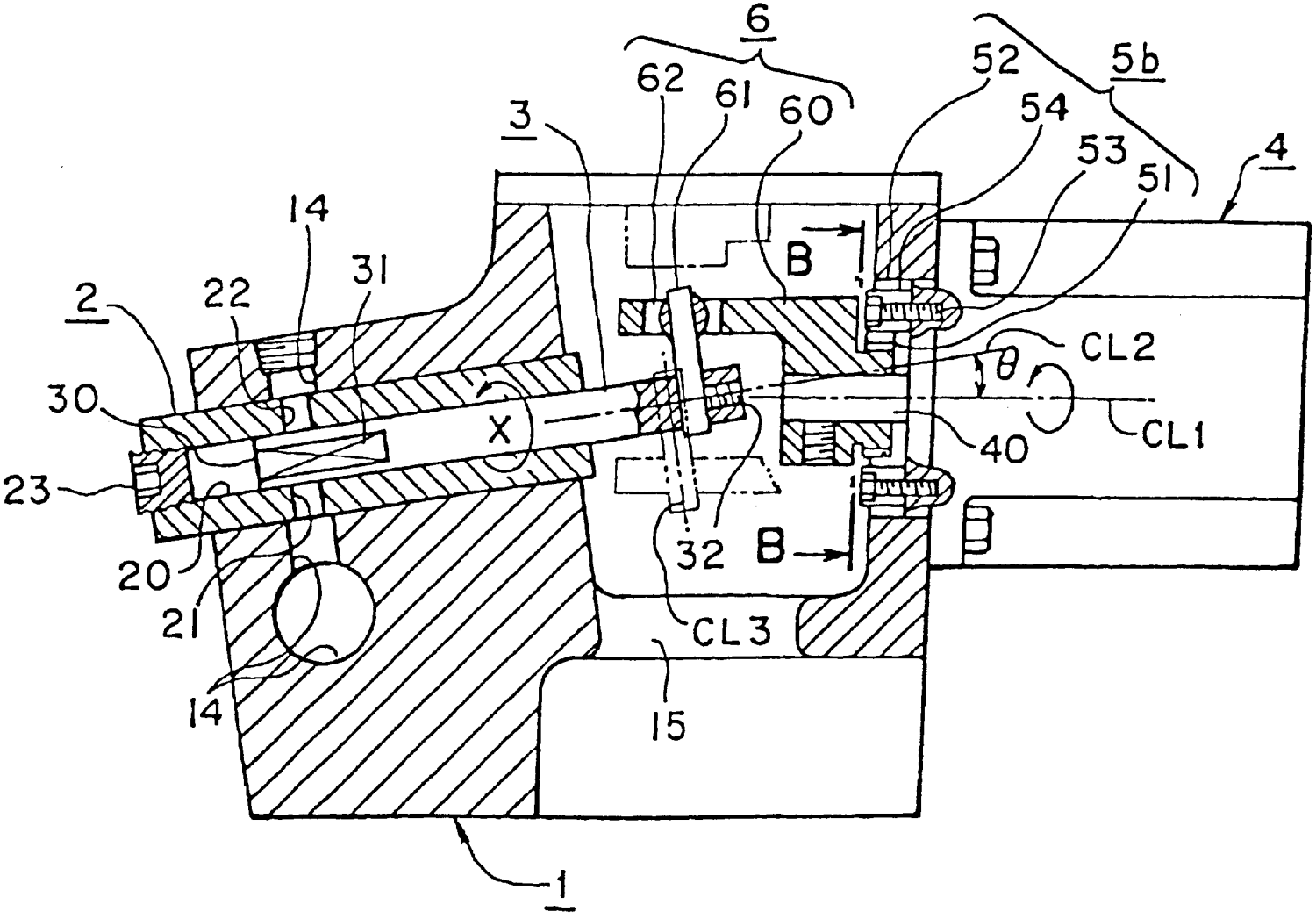
FIG. 2 is a cross-sectional view taken along the AA line of FIG. 5 and showing a second embodiment mode of this invention.
Figure 4:
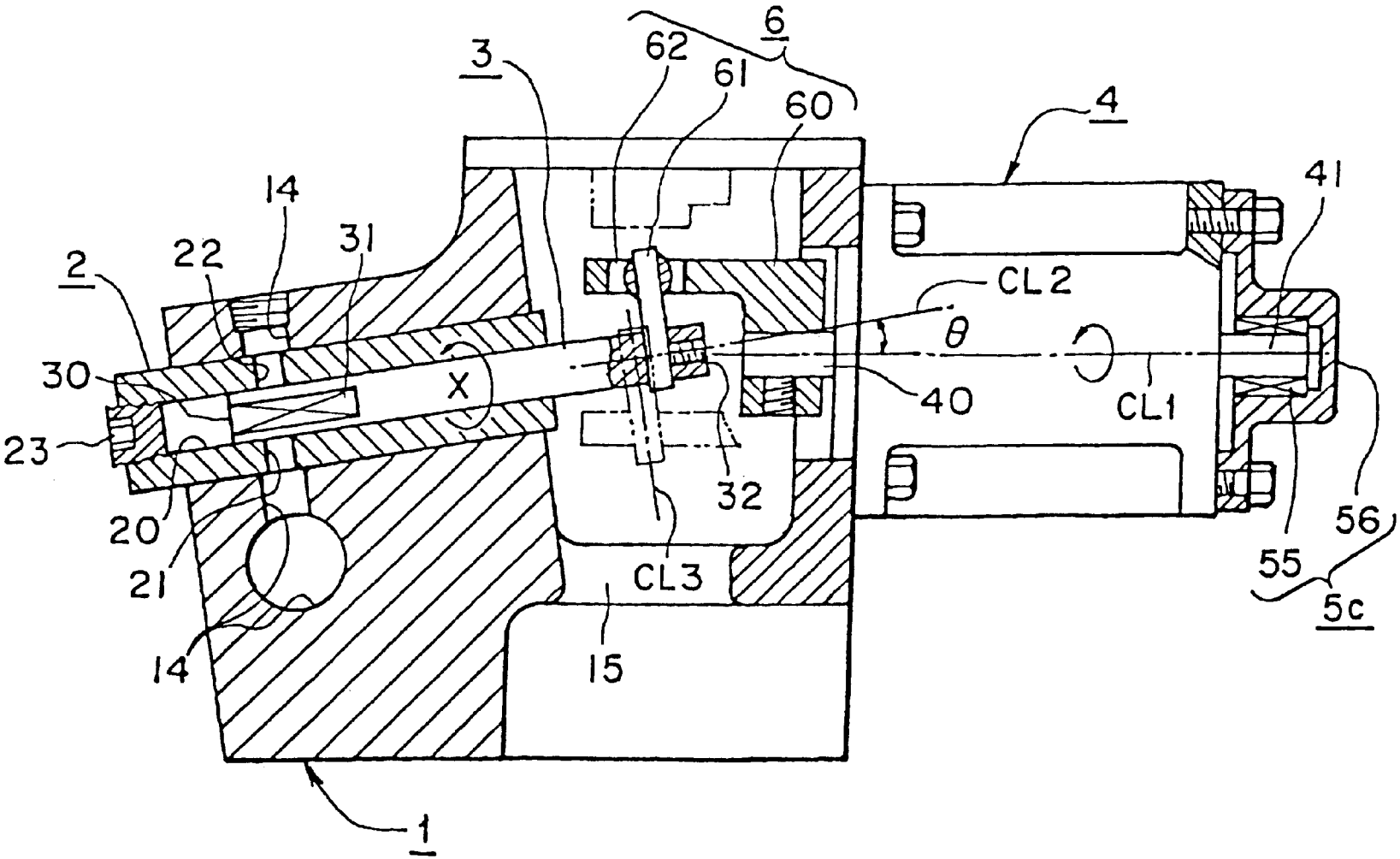
FIG. 4 is a cross-sectional view corresponding to the AA line of FIG. 5 and showing a third embodiment mode of this invention.
Figure 5:
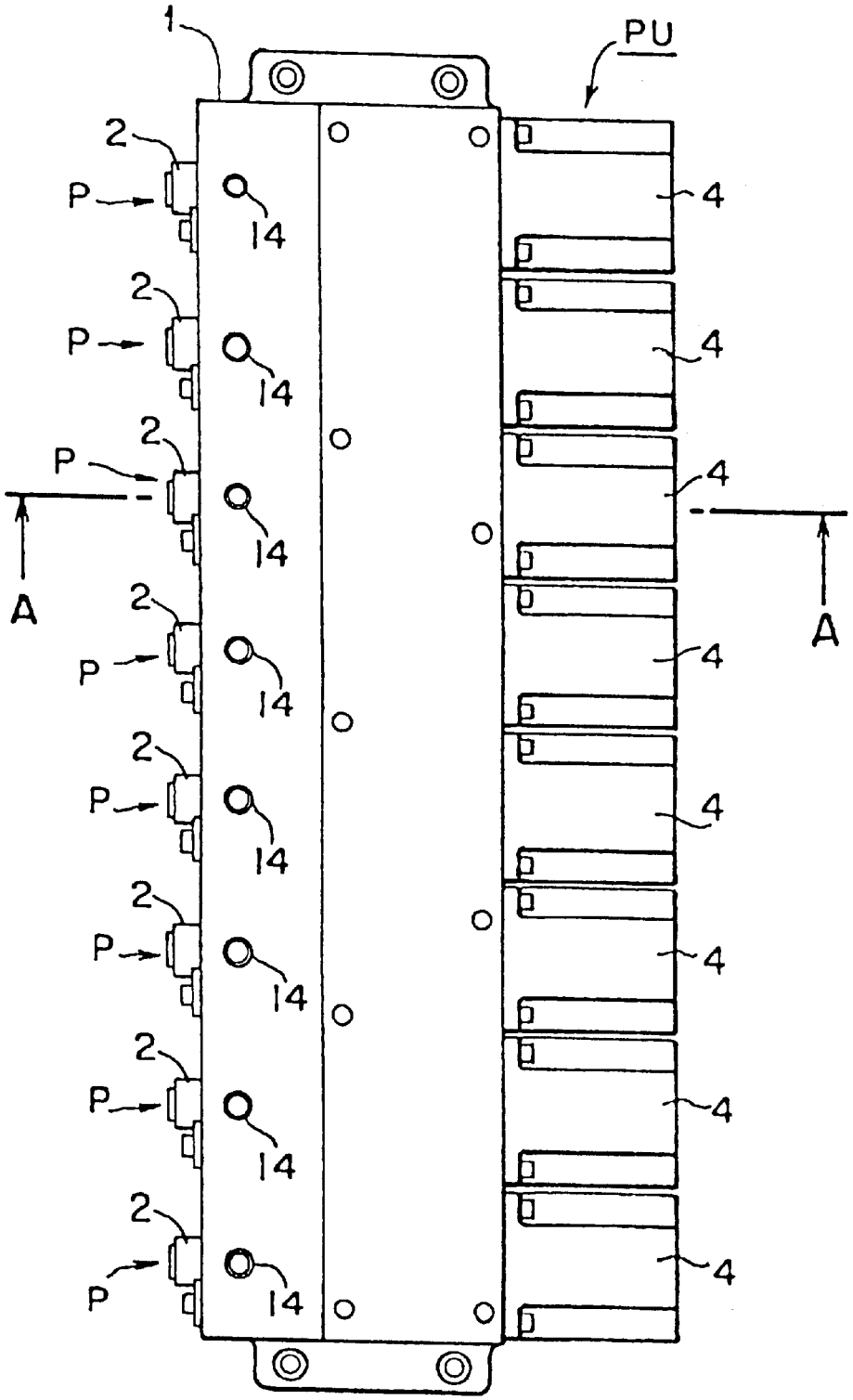
FIG. 5 is a plan view common to the first, second and third embodiment modes of this invention and showing a pump unit for supplying ink in which eight pumps are assembled into a base.

A construction common to first, second and third embodiment modes in this invention will be explained on the basis of FIGS. 1, 2, 4 and 5. FIG. 1 is a cross-sectional view taken along an AA line of FIG. 5 and showing the first embodiment mode of this invention. FIG. 2 is a cross-sectional view taken along the AA line of FIG. 5 and showing the second embodiment mode of this invention. FIG. 4 is a cross-sectional view corresponding to the AA line of FIG. 5 and showing the third embodiment mode of this invention. FIG. 5 is a plan view common to the first, second and third embodiment modes and showing a pump unit PU for supplying ink in which eight pumps P are assembled into a base 1.

A pump P has a cylinder 2 and a plunger 3. The cylinder 2 is fixed to one side of a block-shaped base 1 integrally formed through the space of a hollow portion f this base 1. The plunger 3 is fitted and inserted into a main hole 20 of the cylinder 2 so as to be rotated and reciprocated. One end of the main hole 20 of the cylinder 2 is closed by a plug 23. Two holes compose a suction hole 21 and a discharge hole 22 which cross the center of the main hole 20 and vertically extend through the cylinder 2. The suction hole 21 is connected by piping to an unillustrated ink tank as a fluid supply source through plural fluid passages 14 arranged in the base 1. The discharge hole 22 is connected by piping to an unillustrated ink rail as a fluid supply destination through the plural fluid passages 14 arranged in the base 1.

A notch 31 reaching to the plunger end tip 30 on a fitting side of the plunger 3 is formed in a portion of the plunger 3 fitted to the main hole 20. The notch 31 alternately communicates the suction hole 21 and the discharge hole 22 with the main hole 20 every half rotation in accordance with the rotation of the plunger 3. The suction hole 21 and the discharge hole 22 are simultaneously closed by the plunger 3 in a rotating phase in which the notch 31 is not opposed to either the suction hole 21 and the discharge hole 22.

A motor 4 is fixed to the base 1 on the other side of the base 1 through the space of the hollow portion of this base 1 such that a rotating central line CL1 of an output shaft 40 of the motor 4 and a rotating central line CL2 of the plunger 3 fitted and inserted into the main hole 20 of the cylinder 2 cross each other at a predetermined crossing angle θ. In each of the embodiment modes of this invention, the motor 4 is a stepping motor 4 driven through an unillustrated motor driver in accordance with an inputted pulse signal. An operation of the stepping motor 4 is controlled such that the number of rotations of this stepping motor per unit time is equal to a suitable number. For example, a rotating angle formed once by a group of pulse signals continuously inputted, i.e., a displacing angle is set to 45 degrees. Thereafter, the operation of the stepping motor 4 is controlled such that the stepping motor 4 is intermittently rotated by an unillustrated control means so as to stop the rotation of the stepping motor until a group of new pulse signals are inputted to the stepping motor.

Figure 6:
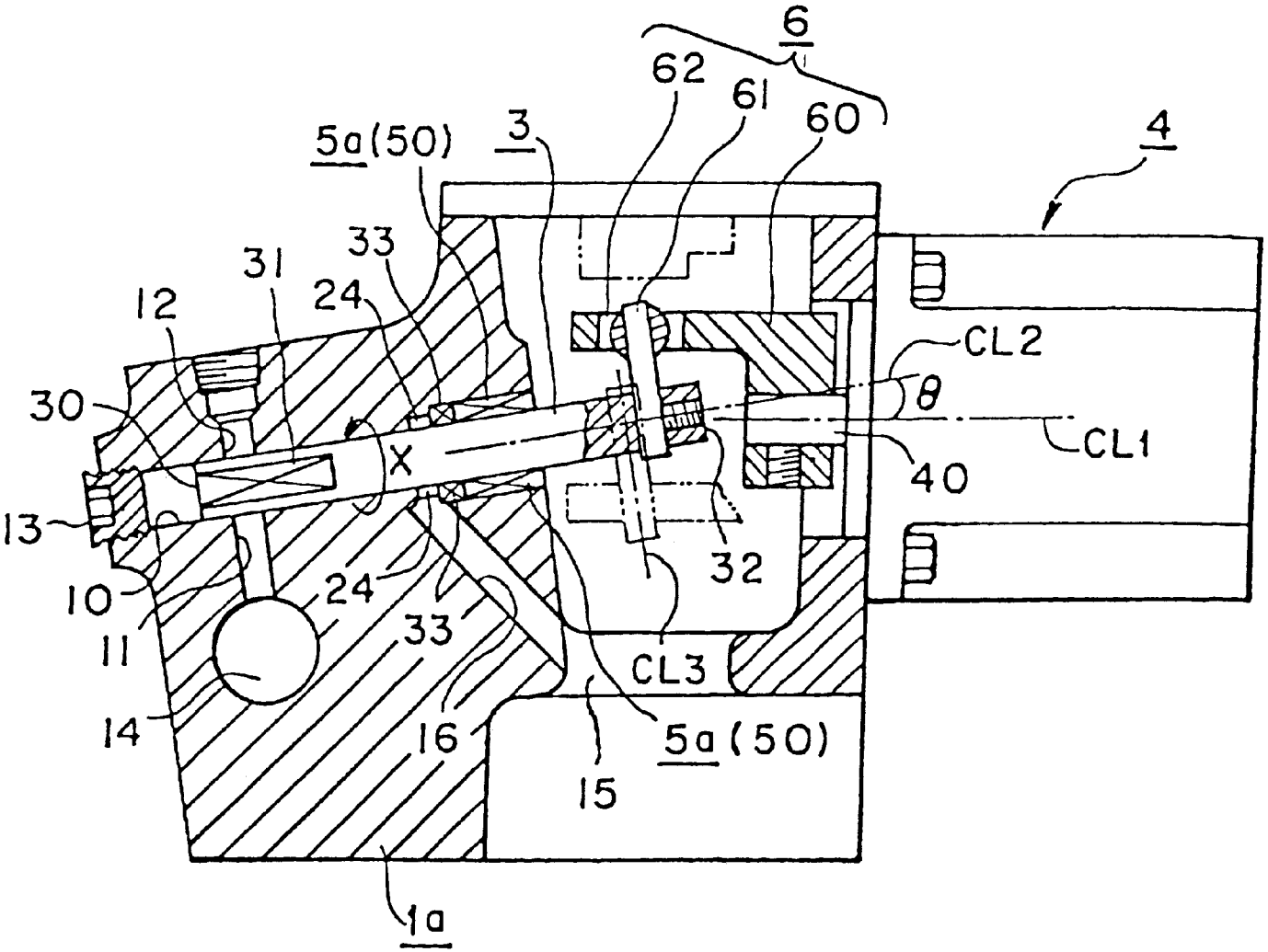
FIG. 6 is a cross-sectional view-corresponding to the cross-sectional view taken along the AA line of FIG. 5 and showing a fourth embodiment mode of this invention.
Figure 7:
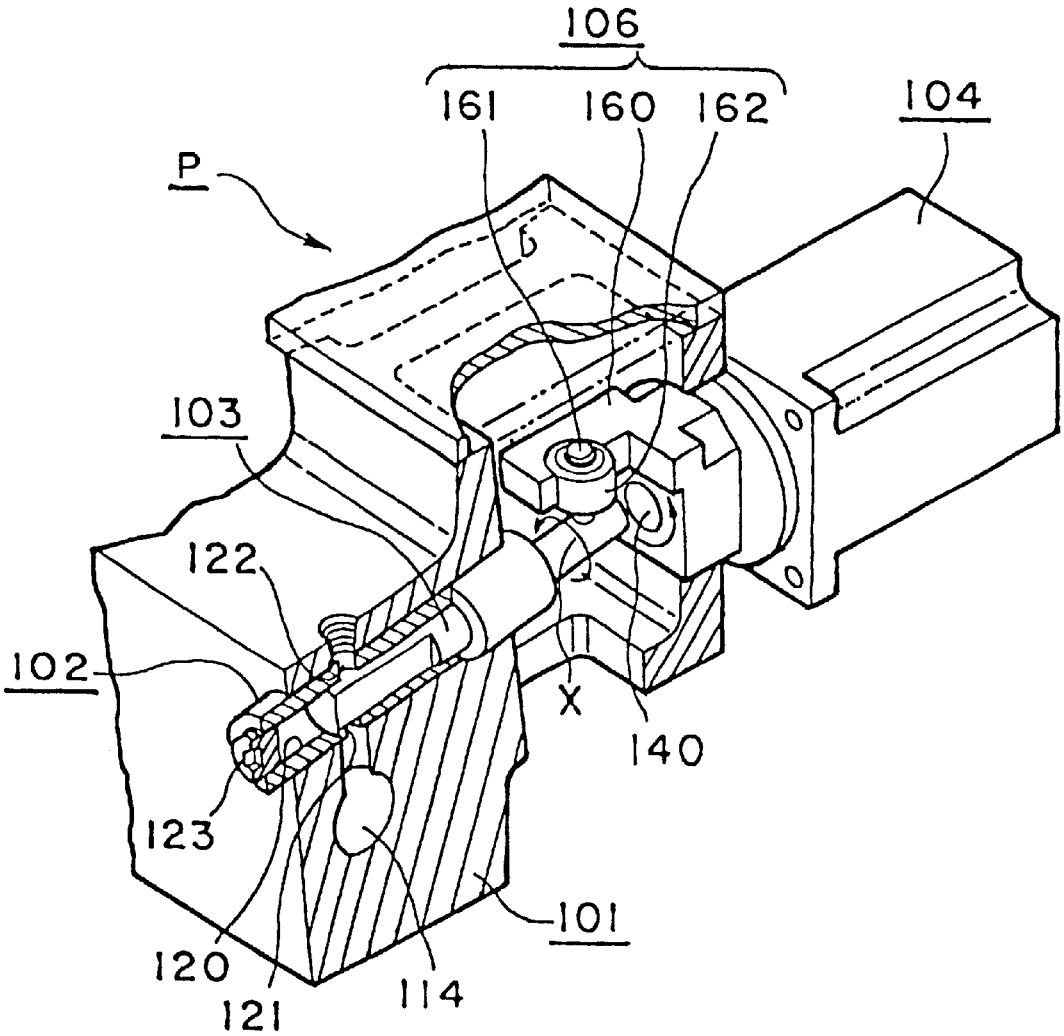
FIG. 7 PRIOR ART
FIG. 7 is a partial sectional perspective view of a pump of the prior art.
Figure 8A:
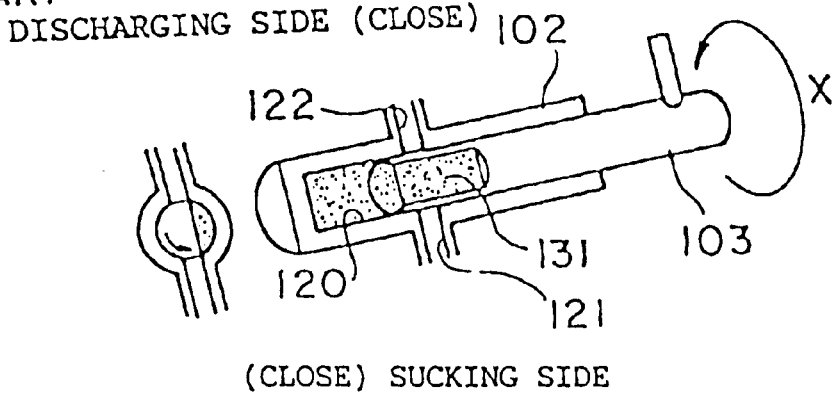
FIG. 8a PRIOR ART
FIGS. 8*a*–8*f* is a partial sectional perspective explanatory view showing an operating mode of a plunger of the prior art.
Figure 8B:
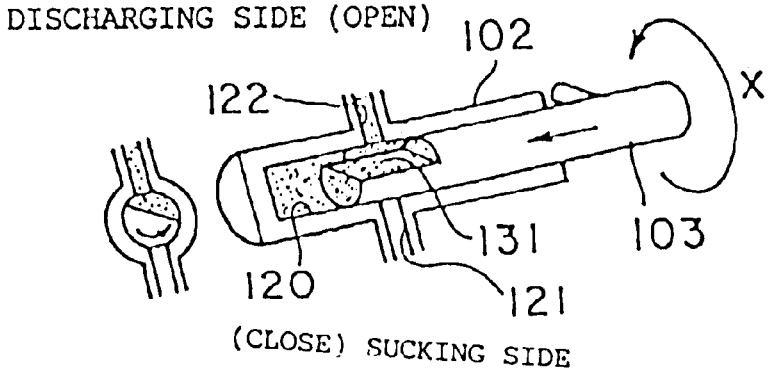
FIG. 8b PRIOR ART
Figure 8C:
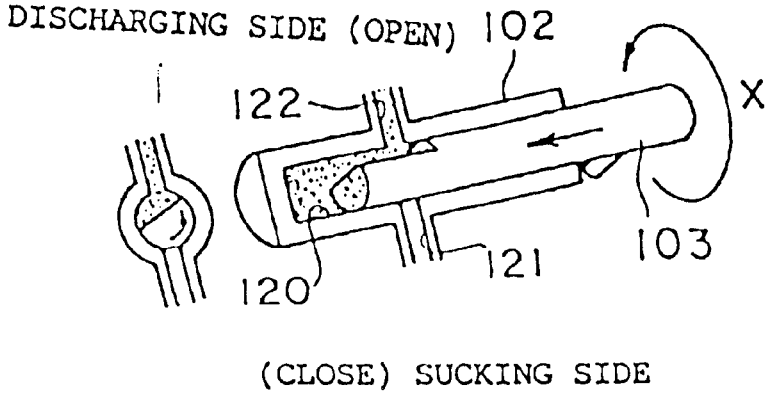
FIG 8c PRIOR ART
Figure 8D:
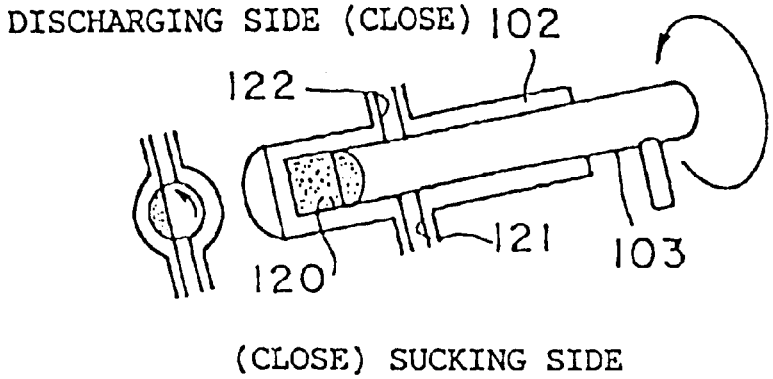
FIG. 8d PRIOR ART
Figure 8E:
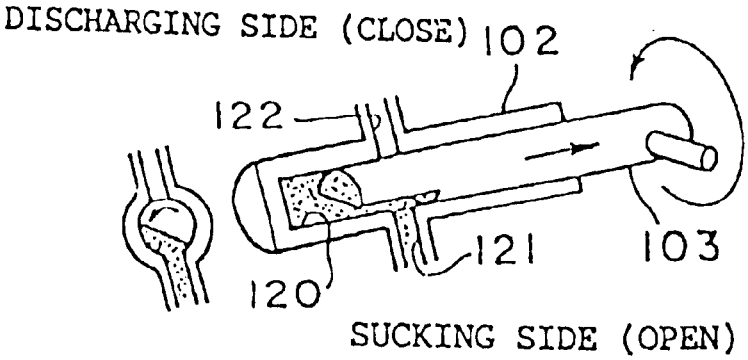
FIG. 8e PRIOR ART
Figure 8F:
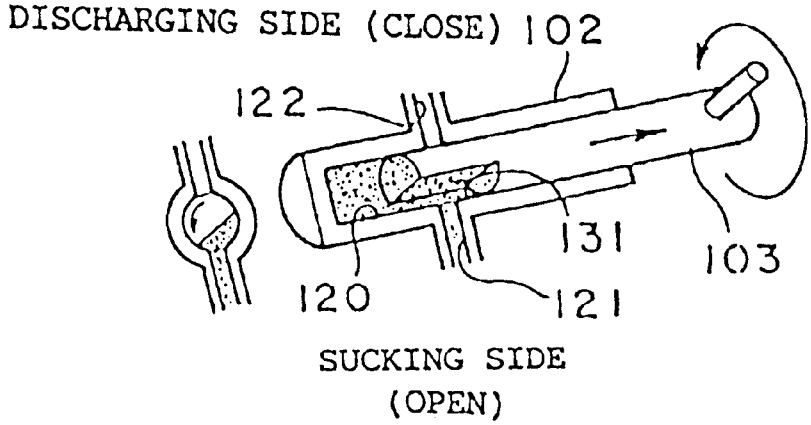
FIG. 8f PRIOR ART
Figure 9:
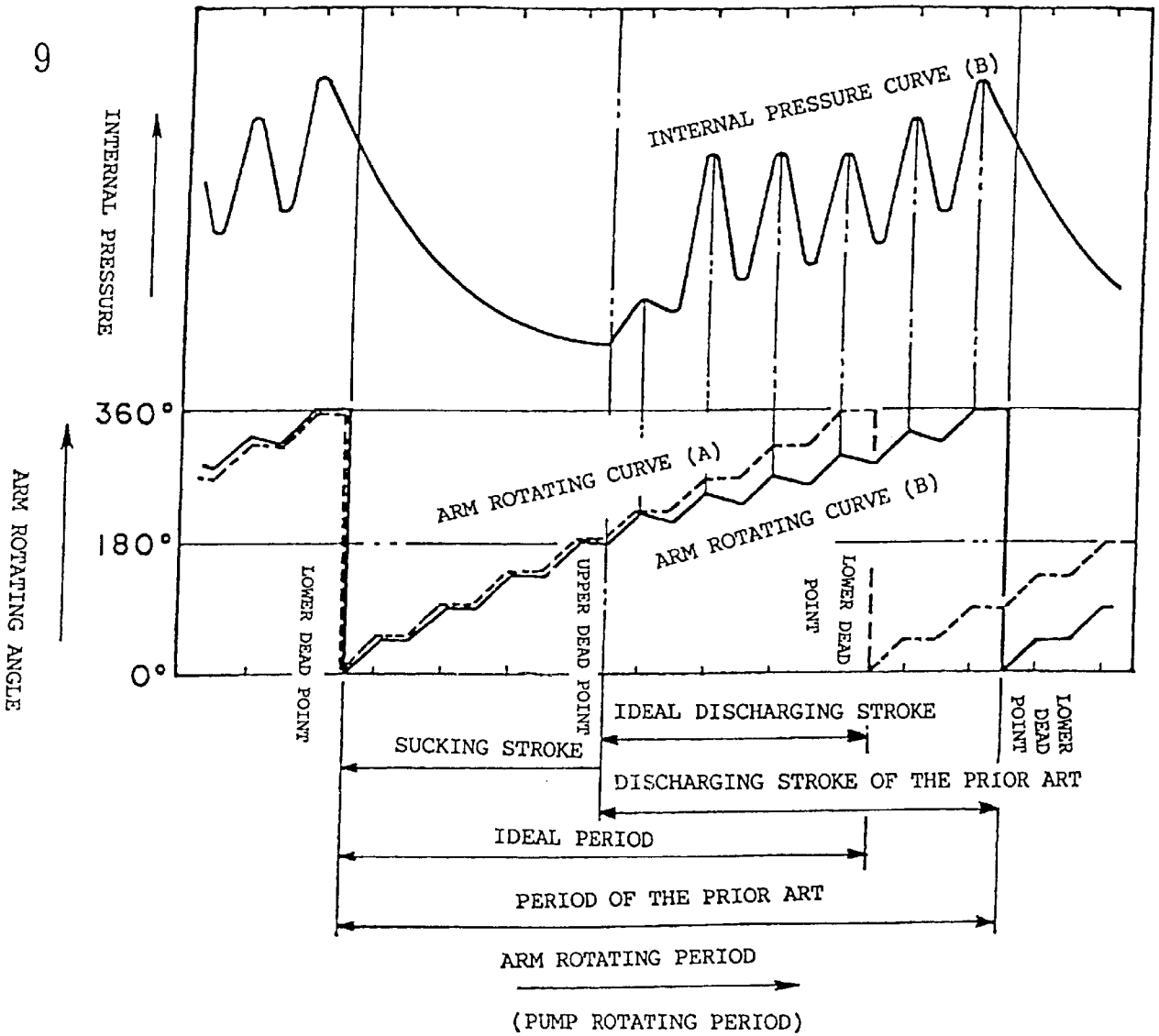
FIG. 9 is a graph showing the relation of an arm rotating angle and the internal pressure of a fluid passage on the side of a discharge hole with respect to the rotating period of an arm in the prior art.

A fourth embodiment mode of this invention will next be explained on the basis of FIG. 6. FIG. 6 is a cross-sectional view of a pump in a position corresponding to the AA line of FIG. 5 in the fourth embodiment mode.

The pump P has a plunger 3 fitted and inserted into a main hole 10 so as to be rotated and reciprocated. The main hole 10 is arranged on one side of a cylinder-base 1*a* through the space of a hollow portion of this cylinder-base 1*a*. The cylinder-base 1*a* is formed in the shape of an integral block and is also used as a cylinder. One end of the main hole 10 of the cylinder-base 1*a* is closed by a plug 13. Two holes composed of a suction hole 11 and a discharge hole 12 cross a center of the main hole 10 and vertically extend through the cylinder-base 1*a*. The suction hole 11 is connected by piping to an unillustrated ink tank as a fluid supply source. The discharge hole 12 is connected by piping to an unillustrated ink rail as a fluid supply destination.

Similar to the first to third embodiment modes, a notch 31 reaching until a plunger end tip 30 on a fitting side of the plunger 3 is formed in a portion of the plunger 3 fitted to the main hole 10. The notch 31 alternately communicates the suction hole 11 and the discharge hole 12 with the main hole 10 every half rotation in accordance with the rotation of the plunger 3. The suction hole 11 and the discharge hole 12 are simultaneously closed by the plunger 3 in a rotating phase in which notch 31 is not opposed to either the suction hole 11 or the discharge hole 12.

A motor 4 is fixed to the cylinder-base a on the other side of the cylinder-base 1*a* through the space of the hollow portion of this cylinder-base 1*a* such that a rotating central line CL1 of an output shaft 40 of the motor 4 and a rotating central line CL2 of the plunger 3 fitted and inserted into the main hole 10 cross each other at a predetermined crossing angle θ.

In the first to fourth embodiment modes of this invention, a transmission mechanism 6 for rotating and reciprocating the plunger 3 by rotating the stepping motor 4 is arranged in the hollow portion of the base 1 or the cylinder-base 1*a*. The transmission mechanism 6 corresponding to the stepping motor 4 has an arm 60 and a connection member 61. The arm 60 is fixed to the output shaft 40 away from a rear end portion 32 of the plunger 3 fitted and inserted into the man hole 20 or 10. The arm 60 is projected approximately in parallel with the rotating central line CL1 of the output shaft 40. The connection member 61 connects an end tip portion side of the arm 60 with a rear end portion side of the plunger 3.

One side of the connection member 61 is fixed to the plunger 3 and the other side is slidably attached to an inner ring hole of a spherical bearing 62 in a state in which an axis CL3 of the connection member 61 crosses the rotating central line CL2 of the plunger 3 by a predetermined angle (a right angle in the embodiment modes of this invention) at any time. The connection member 61 is connected to the arm 60 through the spherical bearing 62 so as to change a connecting angle. In the embodiment modes of this invention, the connecting angle is changed between angles α and β. When the plunger 3 is located in a rotating phase for simultaneously closing the suction holes 21, 11 and the discharge holes 22, 12, the crossing angle between the axis CL3 of the connection member 61 and the rotating central line CL1 of the output shaft 40 becomes maximum (β) at the final stage of a sucking stroke and becomes minimum (α) at the final stage of a discharging stroke.

In the relation of the suction holes 21, 11 and the discharge holes 22, 12 and the notch 31, the plunger 3 is reciprocated once by rotating the stepping motor 4 once while the plunger 3 is rotated once. The plunger 3 closes both the suction holes 21, 11 and the discharge holes 22, 12 when the plunger 3 is located at both upper and lower dead points in this one reciprocation. When the plunger 3 is separated from the lower dead point and is moved in a direction separating from the main holes 20, 10, the suction holes 21, 11 are respectively communicated with the main holes 20, 10 by the notch 31. In contrast to this, when the plunger 3 is separated from the upper dead point and is moved in an inserting direction of the main holes 20, 10, the discharge holes 22, 12 are respectively communicated with the main holes 20, 10 by the notch 31.

The pump P in the embodiment modes of this invention is used in the singular or plural combination. When plural pumps are used, these pumps are used as a pump unit PU as shown in FIG. 5. A retrogression preventing means 5 (5*a*, 5*b*, 5*c*) is arranged in a series of rotating members forming the pump P. Rotation of the pump P is intermittently controlled such that the pump P is in an unmagnetizing state at a stopping time of an operation of the stepping motor 4 and is angularly displaced by 45 degrees at an operating time of the stepping motor 4.

A first retrogression preventing means 5*a* in the first and fourth embodiment modes of this invention will first be explained on the basis of FIGS. 1 and 6. The plunger 3 is fitted and inserted into the main hole 20 or 10 of the cylinder 2 fixed to one side of the base 1 or the cylinder-base 1*a* through the space of the hollow portion thereof such that the plunger 3 can be rotated and reciprocated. The first retrogression preventing means 5*a* is arranged in an end portion facing a hollow portion side of the main hole 20 or 10 of the cylinder 2 such that plunger 3 does not retrograde. The first retrogression preventing means 5*a* in the fourth embodiment mode shown in FIG. 6 can be constructed instead of a second retrogression preventing means 5*b* or a third retrogression preventing means 5*c* described later.

In the first retrogression preventing means 5*a*, the plunger 3 is fitted and inserted into a one-way clutch 50 of a roller type in which a wedge face is formed on the inside diameter face of an outer ring. When the plunger 3 is rotated in the predetermined direction of an arrow X, the one-way clutch 50 is not operated and the plunger 3 can be reciprocated by rotating the stepping motor 4 while the plunger 3 is freely rotated. At the discharging stroke at which the plunger 3 is rotated and moved from the upper dead point to the lower dead point, when the plunger 3 is angularly displaced in a direction reverse to the arrow X by an internal pressure left in the ink piping on a discharging side during stoppage of the stepping motor 4 while the plunger 3 is pushed back, the one-way clutch 50 is operated and retrogression of the plunger 3 is instantly prevented. As shown in FIGS. 1 and 6, a scraper 33 adjacent to the first retrogression preventing means 5*a* can be arranged inside the main hole 20 or 10 near an end tip 30 of the plunger 3 such that no ink enters the first retrogression preventing means 5*a*. The ink can be scraped off from the surface of the plunger 3 by the scraper 3. Namely, a groove 24 adjacent to the scraper 33 is formed inside the main hole 20 or 10 on a side of the end tip 30 of the plunger 3. A hole 25 and a communicating path 16 are formed in this groove 24. The hole 25 extends through the cylinder 2 from below. The communicating path 16 is communicated with the hole 25 and is opened in the vicinity of a releasing portion 15 of the base 1. If the ink is leaked from the main hole 20 or 10, the ink is scraped off by the scraper 33. The leaked ink can be then discharged from the communicating path 16 through the groove 24 and the hole 25 (there is no hole 25 in FIG. 6).

At the discharging stroke at which the plunger 3 is moved from the upper dead point to the lower dead point, i.e., in the inserting direction of the main hole 20 or 10 while the plunger 3 is rotated, the first retrogression preventing means 5*a* can instantly and reliably prevent the retrogression of the plunger 3 when it is pushed back and beginning to be angularly displaced in a reverse direction during stoppage of the stepping motor 4 by the internal pressure left in the ink piping on the discharging side by operating the one-way clutch 50 arranged on a side of the main hole 20 or 10.

Figure 3:
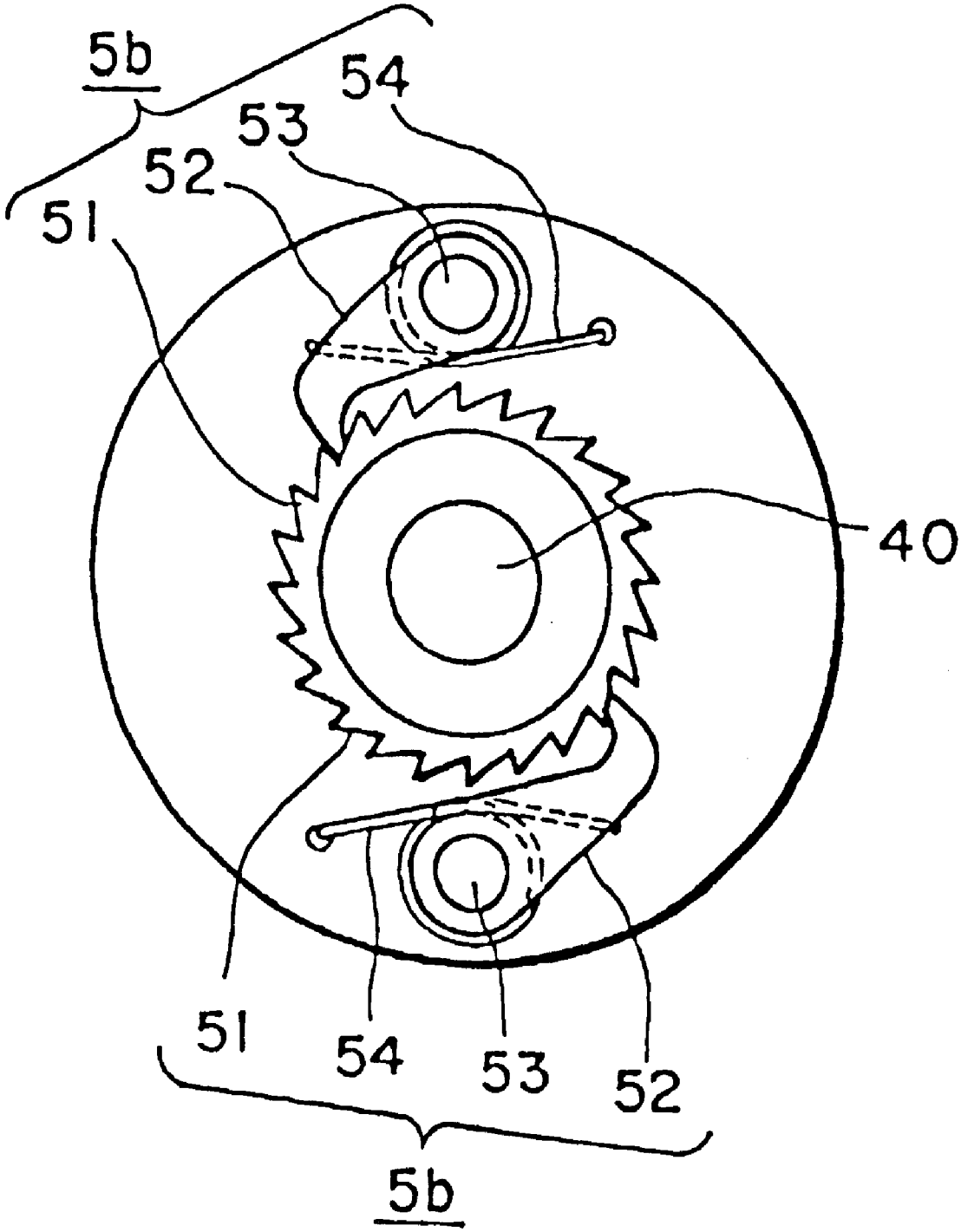
FIG. 3 is a partial sectional view taken along a BB line of FIG. 2 and showing a second retrogression preventing means in the second embodiment mode of this invention.

A second retrogression preventing means 5*b* in the second embodiment mode of this invention will next be explained on the basis of FIGS. 2 and 3. The stepping motor 4 is fixed to the base 1 on the other side of the base 1 through the space of the hollow portion thereof such that the rotating central line CL1 of the output shaft 40 of the stepping motor 4 and the rotating central line CL2 of the plunger 3 fitted and inserted into the main hole 20 of the cylinder 2 cross each other by a predetermined crossing angle θ. An arm 60 is fixed to the output shaft 40 and rotating power is transmitted to the plunger 3 through a transmission mechanism 6.

In the second retrogression preventing means 5*b*, a ratchet wheel 51 having a suitable number of teeth and a suitable tooth width with the rotating central line CL1 as a center is arranged integrally with the arm 60 in an end portion of the arm 60 on a side of the stepping motor 4. A claw 52 is supported by a pin 53 so as to be angularly displaced and is engaged with a tooth-shaped portion toothed on a circular circumference of the ratchet wheel 51 when the arm 60 begins to retrograde. One end portion of the pin 53 is fixed to an end face of the stepping motor 4. A torsion spring 54 is arranged to press the claw 52 against the circular circumference of the ratchet wheel 51 at any time. When the arm 60 begins to be angularly displaced in a direction reverse to the predetermined direction of the arrow X, the claw 52 in the second retrogression preventing means 5*b* is instantly engaged with the tooth-shaped portion of the ratchet wheel 51 and prevents the retrogression of the arm 60. In the second retrogression preventing means 5*b*, two claws are formed on the circular circumference of the ratchet wheel 51 such that an engaging position of one claw 52 is shifted by a half pitch in phase from an engaging position of the other claw 52. However, the number of claws 52 may be set to a suitable number from one to plural in consideration of retrogression preventing effects, etc. No torsion spring 54 is required when a combination of the ratchet wheel 51 and the claw 52 is set to a metallic claw 52 having a magnetic property with respecter the ratchet wheel 51 of a magnetic substance such as iron, etc.

In the second retrogression preventing means 5*b*, the retrogression of the plunger 3 when it is pushed back and beginning to be angularly displaced in the reverse direction during stoppage of the stepping motor 4 by the internal pressure left in the ink piping on the discharging side at the discharging stroke is transmitted to the arm 60 of the transmission mechanism 6 so that the arm 60 begins to be angularly displaced in the reverse direction. The claw 52 pressed against the ratchet wheel 51 arranged integrally with the arm 60 by the torsion spring 54 is supported by the pin 53 fixed onto an end face of the stepping motor 4 and is arranged such that this claw 52 is engaged with the tooth-shaped portion of the ratchet wheel 51 in its outer circumference. Therefore, when the plunger 3 begins to be angularly displaced in the reverse direction, the claw 52 is instantly engaged with the tooth-shaped portion so that the retrogression of the plunger 3 is reliably prevented.

A third retrogression preventing means 5*c* in the third embodiment mode of this invention will next be explained on the basis of FIG. 4. The stepping motor 4 is fixed to the base 1 on the other side of the base 1 through the space of the hollow portion thereof such that the rotating central line CL1 of the output shaft 40 of the stepping motor 4 and the rotating central line CL2 of the plunger 3 fitted and inserted into the main hole 20 of the cylinder 2 cross each other by a predetermined crossing angle θ. An arm 60 is fixed to the output shaft 40 and rotating power is transmitted to the plunger 3 through a transmission mechanism 6.

In the third retrogression preventing means 5*c*, a one-way clutch 55 of a roller type similar to that in the first retrogression preventing means 5*a* is fitted and disposed with a shaft 41 projected to the other side of a motor of a so-called bi-axial type in which one side of the output shaft 40 projected from a body of the stepping motor 4 is extended and projected to an opposite side of this output shaft. Further, a housing 56 for fixing an outer ring portion of the one-way clutch 55 is fixed to an end face of the stepping motor 4.

When the shaft 41 is rotated in a predetermined operating direction, the one-way clutch 55 is not operated. While the plunger 3 is freely rotated in the predetermined direction of an arrow X by rotating the stepping motor 4, the plunger 3 can be reciprocated in accordance with this free rotation. At a discharging stroke at which the plunger 3 is rotated and moved from an upper dead point to a lower dead point, the plunger 3 begins to be angularly displaced in a direction reverse to the direction of the arrow X while the plunger 3 is pushed back by the internal pressure left in the ink piping on the discharging side during stoppage of the stepping motor 4. When this retrogression of the plunger 3 is transmitted to the shaft 41 of the stepping motor 4 through the transmission mechanism 6, the one-way clutch 55 is instantly operated and prevents the plunger 3 from being angularly displaced in the reverse direction.

The retrogression preventing means 5 can be also set to a suitable mechanism coming in contact with the plunger 3 and restraining retreat of the plunger 3 and preventing retrogression.

There are many effects described below in this invention.

(1) When the operation of a motor is temporarily stopped during the operation of a pump intermittently rotated and controlled by the motor at every predetermined angle, it is not necessary to stop the operation of the motor in a magnetizing state. Accordingly, it is possible to prevent the temperature of the motor from being increased by the magnetization and temperatures of the pump and ink from being increased by this rise in temperature of the motor. Therefore, ink supply irregularities caused by the rise in temperature of the ink can be prevented and it is also effective to save energy.

(2) When the motor is in an unmagnetizing state during the operation of the pump intermittently rotated and controlled by the motor at every predetermined angle, the plunger is not pushed back and is not angularly displaced in a reverse direction by the internal pressure left in the ink piping on the discharging side at a discharging stroke at which the plunger is temporarily stopped.

(3) Since it is possible to prevent the plunger from being pushed back and angularly displaced in the reverse direction, the plunger can be accurately angularly displaced and reciprocated. Accordingly, an ink amount required on a printing paper face can be accurately stably supplied to the printing face so that printing quality is improved.

(4) The constructions of respective retrogression preventing means are very simple and can be very easily maintained.

(5) The regression preventing means can be arranged with minimal changes to the arrangement of a conventional rotating control system of the motor. Accordingly, a pump for a printing machine having a stable ink discharging amount can be provided at very low lost.

What is claimed is:

1. A pump for a printing machine for sucking and discharging ink by repeatedly reciprocating a plunger operated by a motor once while the plunger is rotated once within a main hole of a cylinder, the pump comprising:

a base;

the cylinder which is attached to the base and has the main hole closed on one side thereof and also has a suction hole and a discharge hole opened in positions different from each other in phase on an inner circumferential face of the main hole;

the plunger which is fitted onto an opening side of the main hole of the cylinder so as to be axially moved and rotated from an end tip of the main hole and simultaneously close the suction hole and the discharge hole of the cylinder in a certain rotating phase and also close one of the suction hole and the discharge hole in a different rotating phase;

the motor attached to the base such that a rotating central line of a rotating shaft crosses that of the plunger at a predetermined crossing angle;

a transmission mechanism which is constructed by an arm fixed to the output shaft of the motor and approximately projected in parallel with the rotating central line of the output shaft of the motor, and is also constructed by a connection member slidably attached to an inner ring hole of a spherical bearing fixed to the arm and fixed to a rear end side of the plunger and connecting the arm and the plunger to each other; and retrogression preventing means for arranging the plunger temporarily stopped at a discharging stroke during an operation of the pump intermittently operated by the motor such that the plunger is not retreated and not angularly displaced in a direction reverse to a predetermined operating direction.

2. The pump for a printing machine as defined in claim 1, wherein the retrogression preventing means is arranged with at least one rotating member selected from the group consisting of the plunger, the arm, and the output shaft of the motor.

3. A pump for a printing machine for sucking and discharging ink by repeatedly reciprocating a plunger operated by a motor once while the plunger is rotated once within a main hole, the pump comprising:

a cylinder-base which has the main hole closed on one side thereof and also has a suction hole and a discharge hole opened in positions different from each other in phase on an inner circumferential face of the main hole;

the plunger which is fitted onto an opening side of the main hole so as to be axially moved and rotated from an end tip of the main hole and simultaneously close the suction hole and the discharge hole in a certain rotating phase and also close one of the suction hole and the discharge hole in a different rotating phase;

the motor attached to the cylinder-base such that a rotating central line of a rotating shaft crosses that of the plunger at a predetermined crossing angle;

a transmission mechanism which is constructed by an arm fixed to the output shaft of the motor and approximately projected in parallel with the rotating central line of the output shaft of the motor, and is also constructed by a connection member slidably attached to an inner ring hole of a spherical bearing fixed to the arm and fixed to a rear end side of the plunger and connecting the arm and the plunger to each other; and retrogression preventing means for arranging the plunger temporarily stopped at a discharging stroke during an operation of the pump intermittently operated by the motor such that the plunger is not retreated and not angularly displaced in a direction reverse to a predetermined operating direction.

4. The pump for a printing machine as defined in claim 3, wherein the retrogression preventing means is arranged with at least one rotating member selected from the group consisting of the plunger, the arm, and the output shaft of the motor.

* * * * *